US005275481A

United States Patent [19]

Johnson

[11] Patent Number: 5,275,481

[45] Date of Patent: Jan. 4, 1994

[54] CARD ORGANIZER CABINET

[76] Inventor: Leslie D. Johnson, 6014 Loretta St., Lansing, Mich. 48911

[21] Appl. No.: 847,172

[22] Filed: Mar. 6, 1992

[51] Int. Cl.[5] ..... A47B 63/00

[52] U.S. Cl. ..... 312/183; 312/187

[58] Field of Search ..... 312/183, 185, 187, 259; 211/11, 126; 206/449

[56] References Cited

U.S. PATENT DOCUMENTS

| | | | |
|---|---|---|---|
| 254,836 | 3/1882 | Nauerth . | |
| 386,673 | 7/1888 | Wells . | |
| 386,675 | 7/1888 | Wells . | |
| 529,251 | 11/1894 | Edgar | 312/183 |
| 590,666 | 9/1897 | Macrae . | |
| 660,541 | 10/1900 | Field . | |
| 867,599 | 10/1907 | Rand . | |
| 877,600 | 1/1908 | Sawyer . | |
| 970,103 | 9/1910 | Parrott . | |
| 1,030,317 | 6/1912 | Middaugh . | |
| 1,113,182 | 10/1914 | Avery . | |
| 1,467,357 | 9/1923 | Davies . | |
| 1,603,776 | 10/1926 | Joly . | |
| 1,613,570 | 1/1927 | Shotwell . | |
| 2,665,808 | 1/1954 | McAlister | 312/183 |
| 3,224,824 | 12/1965 | Remke | 312/183 |
| 4,544,213 | 10/1985 | Long et al. | 312/183 |
| 4,572,547 | 2/1986 | Phillips | 312/183 |
| 4,756,581 | 7/1988 | Phillips | 312/183 |
| 4,820,001 | 4/1989 | Paul | 312/183 |
| 5,039,178 | 8/1991 | Muenzer et al. | 312/183 |

*Primary Examiner*—Victor N. Sakran
*Attorney, Agent, or Firm*—Ian C. McLeod

[57] ABSTRACT

A card organizer device (10) supported in a cabinet (12) for depositing cards (14) moved into the card organizer device into the cabinet, is described. The card organizer device is comprised of a plurality of elongate, side-by-side holders (40, 42, 44, 46) each having a plurality of compartments (94, 98, 102, 106) for receiving cards that have been first sorted and then moved through the open top of the holders and into the compartments. The holders are also provided with open bottoms. This provides for depositing the cards into boxes (32, 34, 36 and 38) formed in the cabinet when the card organizer device is removed from the cabinet. That way, the cards lay in the boxes of the cabinet in a fanned and sorted order. The sorted cards can then be removed from the cabinet and placed back into a conventional set box container. The sorted cards can then be held in the set box container for appreciation or resale. A cover (114) is also provided that mounts over the cards and the card organizer device mounted in the cabinet to protect the sorted cards.

26 Claims, 4 Drawing Sheets

CARD ORGANIZER CABINET

BACKGROUND OF THE INVENTION

1. Field of the Invention

Figure 1:
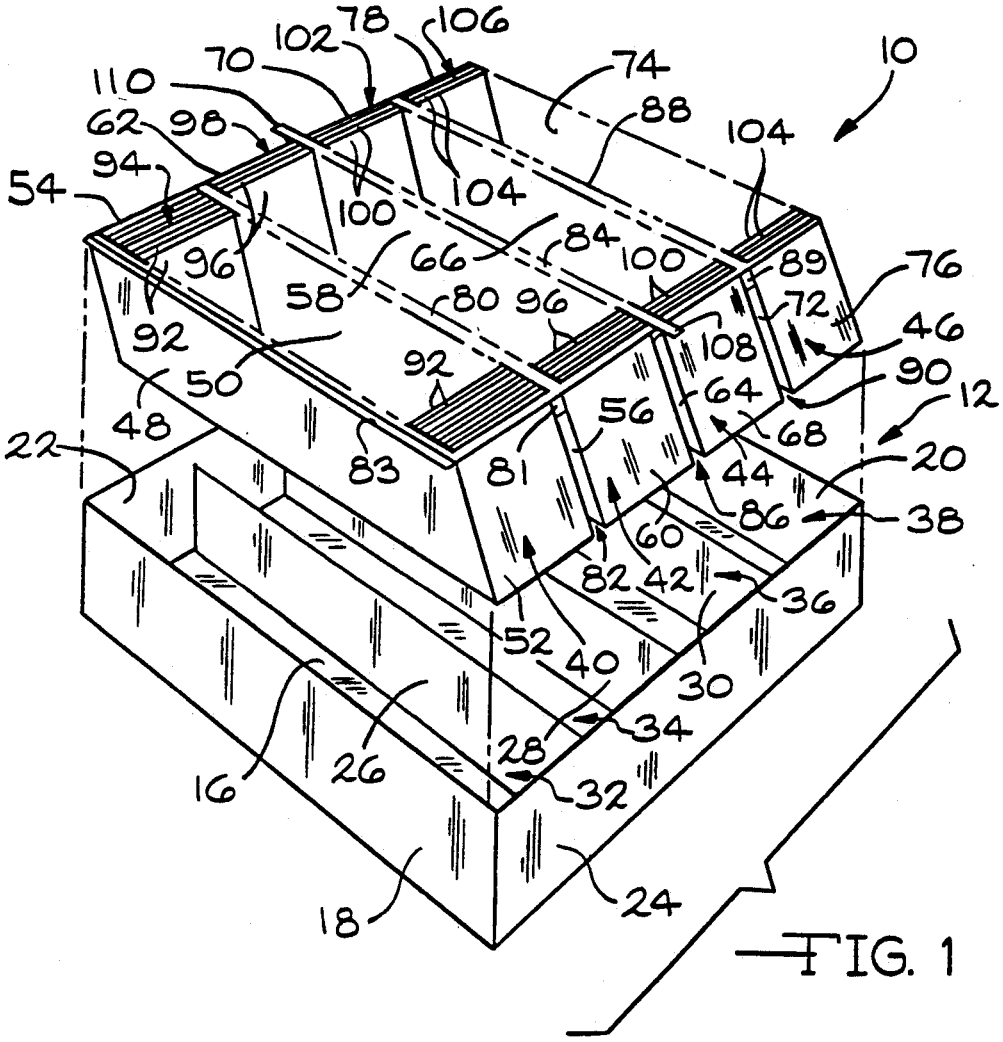

The present invention relates to an organizer device for cards. In particular, the present invention relates to a device for organizing cards, particularly collectible cards, into a container for temporarily holding the cards until they are organized in numerical order. The organized cards are then deposited from the organizer device into the container where they are picked up and placed in a set box container for the cards. A set box container is a package constructed to hold a numbered set of the collectible cards.

The card organizer device is preferably comprised of a plurality of elongate, rectangular shaped holder units, each having an open top and an open bottom. The holder units are connected side-by-side by rims that extend between adjacent holder units. Preferably the width of each holder unit is only slightly wider than the width of the cards to be moved into the organizer device. A plurality of partitions extend between the spaced apart sidewalls of the holder units to provide a plurality of compartments for receiving sorted cards along the length of the holder units. The rims between the adjacent holder units are preferably provided with indicia for labeling the compartments. In use, the card organizer device is first mounted in a container or cabinet. The cards are usually sold in a random order. The cards are then sorted and placed in compartments in a holder unit of the organizer device according to alphabetic, numerical or some other pertinent order. The organizer device can then be removed from the container by grasping finger tabs provided at each end of the organizer device and lifting the organizer device out of the container, leaving the sorted cards in the container. The organized cards deposited in the container are then picked up, in order, and placed back into the set box container for the cards. A removeable cover mounts over the card organizer device mounted in the cabinet to protect the sorted cards while they are held in the organizer device mounted in the container. Also, the card organizer device enables the collectible cards to be sorted and ordered without damaging the cards by scratching their faces or wearing or rounding the card edges. This helps to retain the intrinsic value of the collectible cards.

2. Prior Art

The prior art has described various types of devices for sorting and filing cards, check vouchers, important papers and the like. Some of these devices are provided with moveable partitions for varying the space between adjacent partitions. This enables a user of the device to adjust the size of the compartment formed between adjacent partitions depending on the amount of papers and the like that are filed in a particular compartment. Illustrative of these prior art devices are U.S. Pat. No. 254,836 to Nauerth; U.S. Pat. No. 386,673 to Wells; U.S. Pat. No. 386,675 to Wells; U.S. Pat. No. 590,666 to Macrae; U.S. Pat. No. 660,541 to Field; U.S. Pat. No. 867,599 to Rand; U.S. Pat. No. 877,600 to Sawyer; U.S. Pat. No. 970,103 to Parrott; U.S. Pat. No. 1,030,317 to Middauoh; U.S. Pat. No. 1,603,776 to Joly and U.S. Pat. No. 1,613,570 to Shotwell.

Nauerth describes a file for postal and other cards. The file is comprised of a case having an open side. Partitions are adjustably mounted on rods provided adjacent to an upper wall of the case while recesses are provided on an opposite lower wall. The recesses mate with pins depending from the partitions to limit the lateral movement of the partitions to vary the size of the included compartment.

Wells describes two types of paper or bill files. U.S. Pat. No. 386,673 describes a bill file comprised of a base having a pair of grooves extending lengthwise along opposed side portions of the base. A plurality of partitions are mounted on the base. The partitions have opposed inwardly bent rims at a lower end of the partition that mate with the grooves to provide for adjusting the partitions along the base. U.S. Pat. No. 386,675 describes a bill file comprised of a base having a pair of slide rods mounted lengthwise along opposed side portions of the base. A plurality of partitions are provided with legs having openings that provide for the partitions to slide along the rods for adjusting the partitions. These bill files do not provide for depositing the bills in a container after the bills have been sorted.

Macrae describes a check sorter or separator comprised of an open box-like case having a pair of guide rods extending longitudinally along the inside sidewalls of the case and adjacent to the open top of the case. A plurality of partitions are slideably mounted on the guide rods to form compartments for the checks. A plunger or follower is mounted on the rods at one end of the plurality of partitions. The plunger serves to hold the partitions and sorted checks together in a compressed relationship.

Field describes a portable and collapsible case having a plurality of partitions connected together in the shape of pleated bellows. The partitions have tapered corners for seeing the card held by the partition. When the case is collapsed, a strap can be drawn around the case to hold it in the collapsed position.

Rand describes a sorting device having a base provided with a central groove that extends the majority of the length of the base. A slide rod is mounted along the length of the groove. The slide rod provides for slideably supporting partitions mounted on slide blocks to adjust the distance between the partitions.

Sawyer describes a file case having a false bottom mounted on a base wall of the file case. The false bottom provides for mounting a slide rod. A follower plate is slideably mounted on the slide rod for compressing partitions and cards sorted between the partitions together in the file case. A tip lid is hinged to one of the sidewalls and the opposite sidewall is hinged to the base for opening the case.

Parrott describes a card holder rack that is provided with month and day indicia for filing cards of scheduled events. The partitions in the holder are provided with a cut out portion that permits convenient access to the filed cards. There is no means of removing the filed cards from the back of the holder.

Middaugh describes a file holder having an open front and top sides. A guide rod is mounted between the end walls and adjacent to the bottom. Partitions are slideably mounted on the guide rods to adjust the distance between the partitions for filing papers in the holder. The back of the holder can be opened for removing papers from the holder; however, the file holder is not adapted for sorting cards into a container for the cards.

Shotwell describes an index file having an open top and with a guide rod extending the length of the file, adjacent to the bottom wall. Individual folder units are slideably mounted on the guide rod. The folders have a pocket that provides for mounting papers and the like. An outer flap portion of each folder provides for identifying the contents of the folder.

Joly describes a card sorting device and system for filing. The sorting device is divided into several series of compartments separated by partitions. The series of compartments are useful for successive sorting of cards according to alphabetic order, numerical sequence or some other established criteria. This device does not provide for depositing the sorted cards in a separate container for the cards.

Other patents more remotely related to the present invention include U.S. Pat. No. 1,113,182 to Avery and U.S. Pat. No. 1,467,357 to Davies.

What is not shown by the prior art and what is needed is an organizer device that is mountable in a container, which serves as both a support for the organizer device and as a container for the sorted cards. To serve that purpose, the organizer device needs to have an open top and an open bottom with a plurality of partitions mounted on longitudinal support walls between the open top and bottom. The sorted cards are received in compartments formed by the partitions. After the cards have been sorted, the organizer device can be removed from the container, thus depositing the sorted cards in the container.

OBJECTS

It is therefore an object of the present invention to provide a device for organizing cards and the like wherein after the cards have been sorted into the organizer device, the organizer device can be removed from a container supporting the organizer device for depositing the sorted cards into the container. Further, it is an object of the present invention to provide a method for organizing cards, such as collectible cards and the like into a container for the cards. Finally, it is an object of the present invention to provide a card organizer device that is inexpensive to build, easy to construct and durable in construction for sorting and organizing cards and the like. These and other objects will become increasingly apparent by reference to the following descriptions and to the drawings.

GENERAL DESCRIPTION

The present invention relates to a device for organizing cards into a container means having a bottom wall and an sidewall extending from the bottom wall, which comprises: a holder means for holding the cards and that is adapted to be removeably mounted in the container means, wherein the holder means is comprised of an open top and an open bottom and a surrounding sidewall between the open top and the open bottom and wherein when the holder means is mounted in the container means, the container means helps to support the holder means with the sidewall of the holder means adjacent to and inside of the sidewall of the container means; and a plurality of partition means provided in the holder means to divide the holder means into a plurality of compartments adapted to receive cards moved into compartments of the holder means.

Further, the present invention relates to a device for organizing cards into a container means having a bottom wall with spaced apart sidewalls extending from the bottom wall and opposed end walls between the sidewalls, which comprises: a holder means that is adapted to be removeably mounted in the container means for holding the cards, wherein the holder means has an open top and an open bottom and is comprised of spaced apart sidewalls with opposed end walls between the sidewalls of the holder means and wherein when the holder means is mounted inside the container means, the container means helps to support the holder means with the spaced apart sidewalls of the holder means adjacent to the spaced apart sidewalls of the container means; and a plurality of partition means mounted in the holder means to divide the holder means into a plurality of compartments adapted to receive cards moved into the holder means.

Finally, the present invention relates to a method for organizing cards into a container means having a bottom wall with spaced apart sidewalls extending from the bottom wall and opposed end walls between the sidewalls, which comprises: providing a card organizing device, which comprises: a holder means for the cards having an open top and an open bottom and mountable in the container means, the holder means comprised of spaced apart sidewalls with opposed end walls between the sidewalls of the holder means; and a plurality of partition means mounted in the holder means to divide the holder means into a plurality of compartments for receiving cards moved into the compartments of the holder means; mounting the holder means inside the container means so that the container means helps to support the holder means with the spaced apart sidewalls of the holder means adjacent to the spaced apart sidewalls of the container means; moving the cards into the compartments of the holder means to thereby organize the cards; removing the holder means from the container means to deposit the cards moved into the compartments of the holder means in the container means through the open bottom of the holder means; and removing the cards from the container means and placing the organized cards in a package means.

The card organizer device of the present invention is temporarily mounted in a container or cabinet for the device. The cards, which are preferably collectible cards, are then removed to a set box container, which is the package in which the collectible cards are sold. The collectible cards are usually sold in a random order. The randomly ordered cards are then organized by moving the cards into numbered compartments in the card organizer device. The card organizer device is then removed from the container. This causes the organized cards to be deposited in the container where they can be picked up and placed back into the set box container. The cards are now held in order in the set box container.

IN THE DRAWINGS

FIG. 1 is an isometric and separated view showing the card organizer device 10 of the present invention removed from the cabinet 12 that serves as a support for the organizer device 10 to enable cards 14 to be moved into the card organizer device 10 and deposited in the cabinet 12.

Figure 1A:
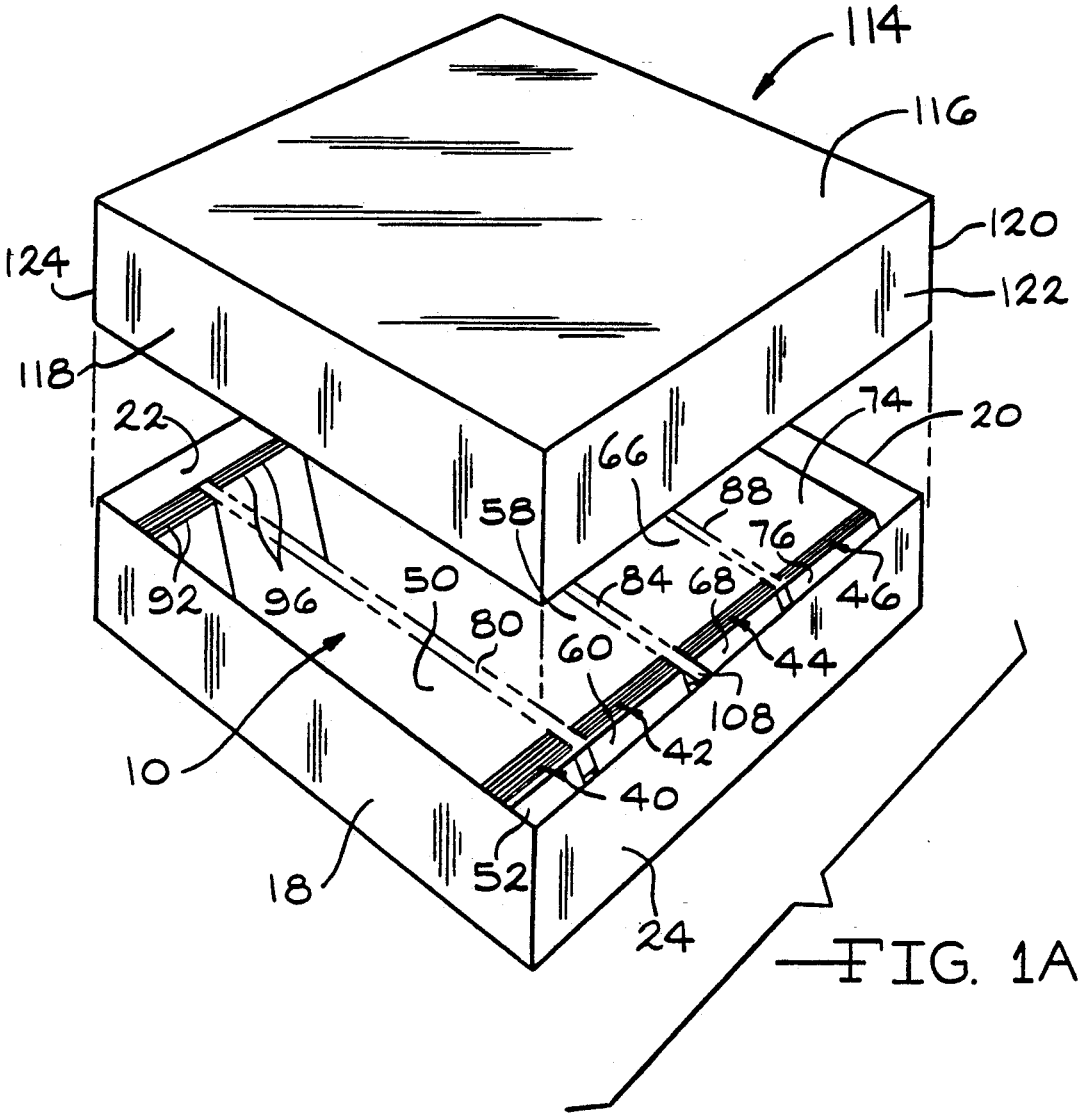

FIG. 1A is an isometric and separated view of the card organizer device 10 shown in FIG. 1 and showing a cover 114 that mounts over the cabinet 12 to protect the cards 14 moved into the card organizer device 10.

Figure 2:
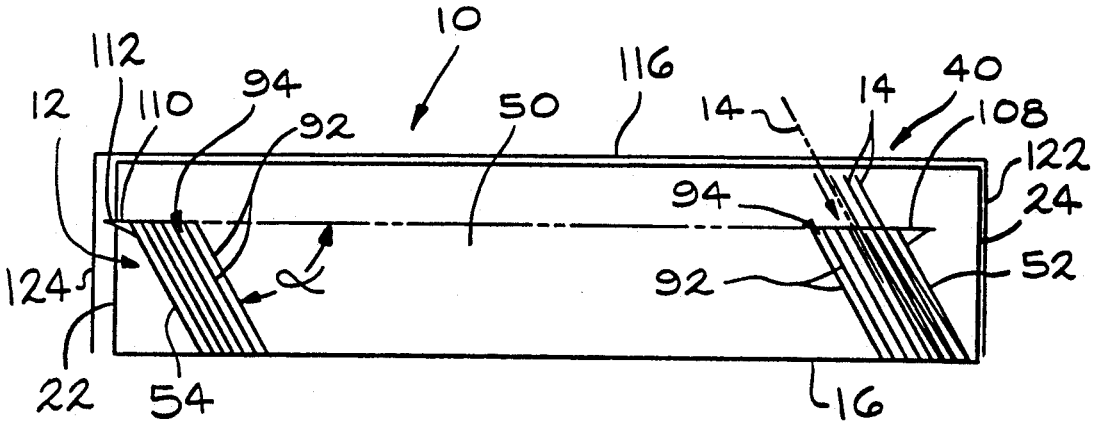

FIG. 2 is a left side view of the card organizer device 10 mounted in the cabinet 12 shown in FIG. 1 and showing a card 14 (in phantom) being moved into a compartment 64 formed between partitions 92 of a holder unit 40 comprising a portion of the card organizer device 10 and with a cover 114 mounted over the card organizer device 10 and the cabinet 12.

Figure 3:
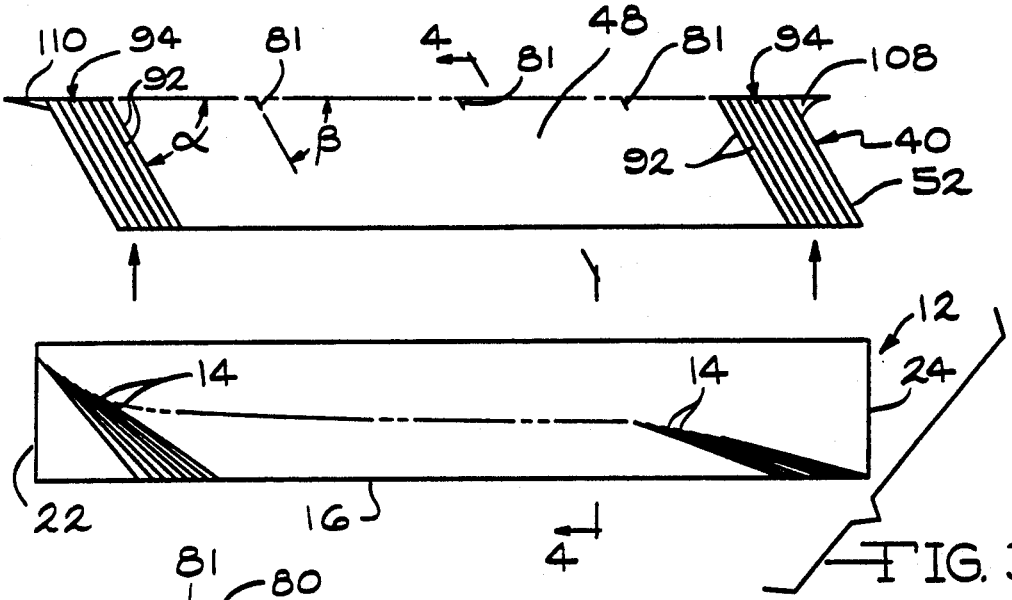

FIG. 3 is a left side separated view of the card organizer device 10 shown in FIG. 1 being removed from the cabinet 12 to deposit the cards 14 in the cabinet 12.

Figure 3A:
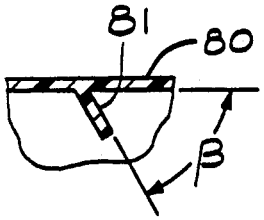

FIG. 3A is a partial expanded view of the card organizer device 10 shown in FIG. 3 and showing the stabilizing tab 81 that adds lateral support between holder units 40 and 42 of the card organizer device 10.

Figure 4:
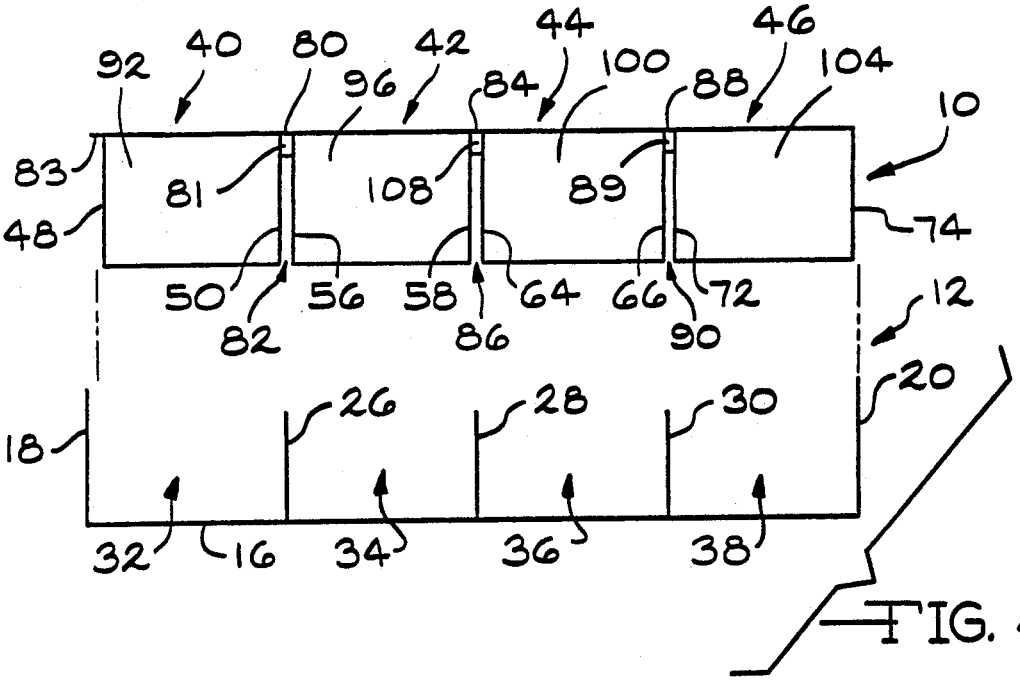

FIG. 4 is a cross-sectional view along line 4—4 of FIG. 3 showing the card organizer device 10 removed from the cabinet 12.

Figure 5:
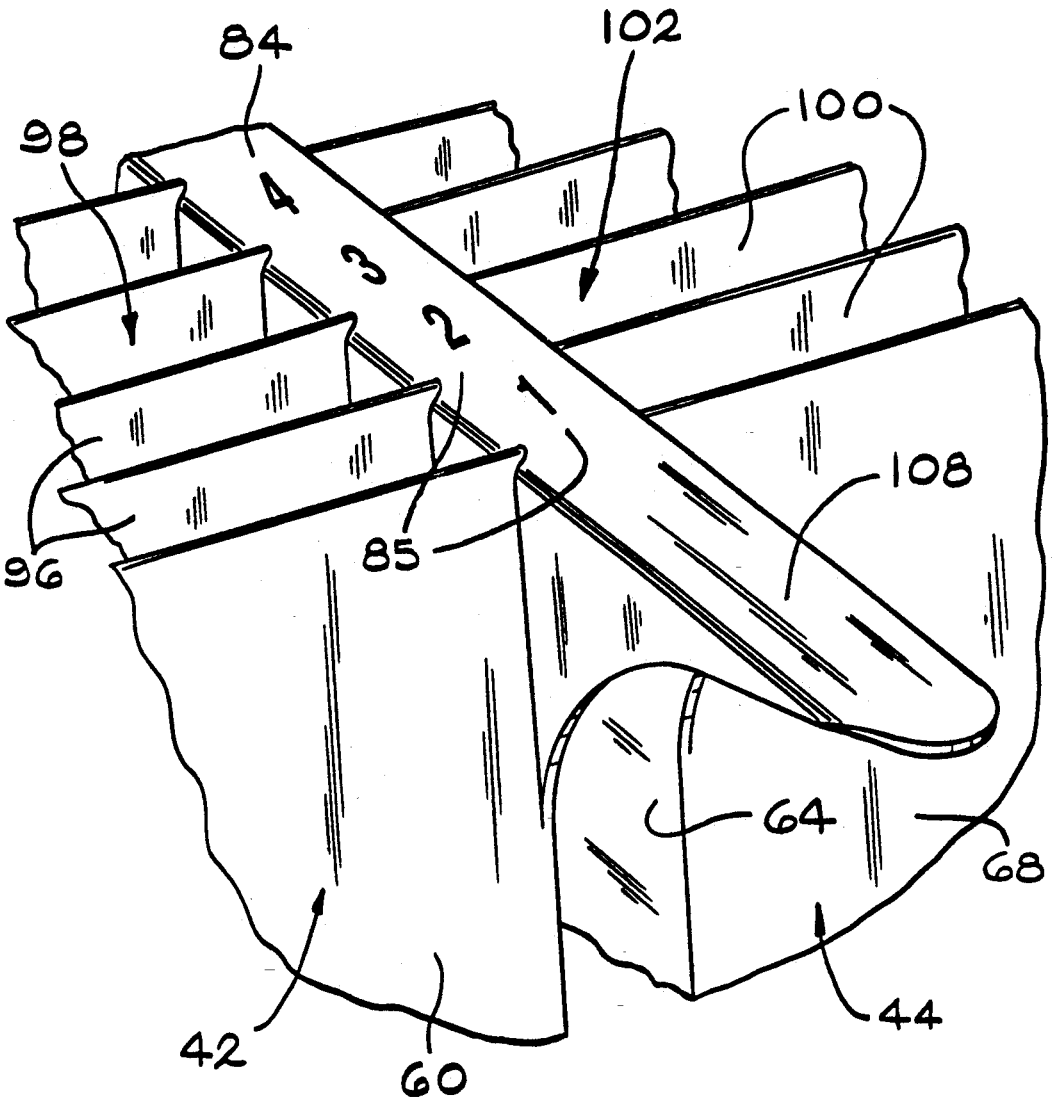

FIG. 5 is an isometric view of a portion of the card organizer device 12 of the present invention showing the rim 84 with rounded edges and numerical indicia 85 and front finger tab 108.

SPECIFIC DESCRIPTION

FIGS. 1 to 4 show the preferred embodiment of a card organizer device 10 of the present invention. The card organizer device 10 is removeably mounted inside of a container or cabinet 12 for depositing cards 14 moved into the card organizer device 10 into the cabinet 12. The cabinet 12 is comprised of a bottom wall 16 having opposed outside sidewalls 18 and 20 extending from the bottom wall 16 and with spaced apart rear and front end walls 22 and 24 extending between the outside sidewalls 18 and 20. Interior sidewalls 26, 28 and 30 extend between the end walls 22 and 24, parallel to the outside sidewalls 18 and 20 to form a plurality of boxes 32, 34, 36 and 38 inside the cabinet 12 for holding the cards 14. The width of the boxes 32, 34, 36 and 38 is preferably about 0.25 inches (0.64 cm) greater than the width of the cards 14. This provides for holding the cards 14 in the cabinet 12 in neatly aligned rows. The outside sidewalls 18 and 20 and the rear and front end walls 22 and 24 preferably extend upwards from the bottom wall 16 a distance of about 4 inches (10.2 cm). Also, the interior sidewalls 26, 28 and 30 extend upwards from the bottom wall 16 a distance of about 2 inches (5.1 cm).

As particularly shown in FIGS. 1 and 4, the card organizer device 10 is comprised of a plurality of holder units 40, 42, 44 and 46 connected together, side-by-side. As shown in FIG. 2, holder unit 40 is representative and is comprised of a first and a second parallel sidewall 48 and 50 joined together by a front wall 52 and a back wall 54. This provides for the holder 40 to have an open top and an open bottom for moving cards 14 into and out of the holder 40. The front and back walls 52 and 54 are preferably angled at a slope of about 60°, with respect to a plane perpendicular to the plane of the first and second sidewalls 48 and 50, as shown by the angle alpha '$\alpha$'. Similarly, holder 42 is comprised of a third and a fourth parallel sidewalls 56 and 58 joined together by an angled front wall 60 and an angled back wall 62 to provide the holder 42 with an open top and an open bottom. Further, holder 44 is comprised of a fifth and a sixth parallel sidewalls 64 and 66 joined together by an angled front wall 68 and an angled back wall 70 to provide the holder 44 with an open top and an open bottom. Finally, holder 46 is comprised of a seventh and an eighth parallel sidewalls 72 and 74 joined together by an angled front wall 76 and an angled back wall 78 to provide the holder 46 with an open top and an open bottom.

As shown in FIG. 1, the first and second holders 40 and 42 are connected together, side-by-side by a rim 80 that joins between the second and third sidewalls 50 and 56. That way, rim 80 forms a space 82 (FIG. 4) between the holders 40 and 42 that provides for positioning the interior sidewall 26 of the cabinet 12 between the holders 40 and 42 when the card organizer device 10 is mounted inside the cabinet 12. The holder unit 40 is completed by a rim 83 that extends horizontally outwards from the sidewall 48. Rim 83 is preferably provided with indicia (not shown) that label the partitions 94 formed in the holder 40, as will be described in detail later.

As shown in end view in FIG. 4, stabilizing tabs 81 are provided between the second and third sidewalls 50 and 56 to add lateral support between the holders 40 and 42 when the card organizer device 10 is removed from the cabinet 12. As shown in FIG. 3, the stabilizing tabs 81 are spaced evenly between the sidewalls 50 and 56, along the length of the holders 40 and 42. Similarly, the second and third holders 42 and 44 are connected together, side-by-side by a rim 84 that joins between the fourth and fifth sidewalls 58 and 64. Rim 84 forms a space 86 between the holders 42 and 44 that enables the interior sidewall 28 of cabinet 12 to mount between the holders 42 and 44 when the card organizer device 10 is mounted inside the cabinet 12. In a similar manner as the stabilizing tabs 81 provided between holders 40 and 42, stabilizing tabs (not shown) are provided between holders 42 and 44. Likewise, the third and fourth holders 44 and 46 are connected together by a rim 88 that forms an intermediate space 90, which provides for the interior sidewall 30 of cabinet 12 to mount between the holders 44 and 46 when the card organizer device 10 is mounted inside the cabinet 12. Stabilizing tabs 89 are also provided between the holders 44 and 46 to add lateral stability to the holders 44 and 46 when the card organizing device 10 is removed from the cabinet 12.

The tabs 81 and 89 are preferably angled at a slope of 60°, as shown by angle '$\beta$' in FIG. 3. An expanded view of tab 81 is shown in FIG. 3A. It is also contemplated by the scope of the present invention that a bar or rod means could connect across the front and rear of the holder units 40, 42, 44 and 46 to provide lateral support for the card organizer device 10.

As shown in FIG. 1, the card organizer device 10 has a plurality of partition members mounted linearly along the length of each of the holder units 40, 42, 44 and 46. As particularly shown in FIGS. 2 and 3, holder 40 has a plurality of evenly spaced apart partitions 92 that extend along the length of the holder 40, between the sidewalls 48 and 50 to form compartments 94 for receiving the cards 14. Preferably, there are fifty (50) or one hundred (100) compartments 94 along the length of the holder 40, although some partitions 92 have been removed from the Figures for clarity. The partitions 92 are slanted at about a 60° angle, as shown by the angle alpha '$\alpha$', and are parallel with the front and back walls 50 and 52. Similarly, holder 42 has a plurality of 60° slanted partitions 96 extending along the length of the holder 42, between the sidewalls 56 and 58 to form compartments 98 for receiving cards 14. There are also preferably fifty (50) or one hundred (100) compartments 98 along the length of the holder 42. Holder 44 also has a plurality of 60° slanted partitions 100 extending along the length of the holder 44, between the sidewalls 64 and 66 to form fifty (50) or one hundred (100) compartments 102 for receiving cards 14. As shown in FIG. 5, rim 84 is provided with number indicia 85 that provides for numbering the compartments 98 and 102 in the holder units 42 and 44. Finally, holder 46 is provided with a plurality of evenly spaced apart partitions 104, slanted at about 60° and extending along the length of the holder 46, between the sidewalls 72 and 74 to form fifty (50) or one hundred (100) compartments 106 for receiving cards 14.

Preferably, the compartments 94, 98, 102 and 106 have a width between their respective partitions 92, 96, 100 and 104 of about 0.125 inches (0.32 cm). This provides a space for moving the cards 14 into the compartments 94, 98, 102 and 106. The rims 83, 80 and 88 are also provided with indicia (not shown) in a similar manner as indicia 85 on rim 84. This provides for numbering the compartments 94 and 106 in the holder units 40 and 46.

As exemplified in FIG. 5, the rim 84 between the holder units 42 and 44 has rounded sides extending into the adjacent compartments 98 and 102. The upper edges of the partitions 96 and 100 are also rounded. This prevents the faces of the cards 14 from being scratched and the edges of the cards 14 from being worn and rounded when the cards 14 are moved into the compartments 98 and 102. Any noticeable damage to a collectible card 14 can substantially reduce the intrinsic value of the card 14. The other rims 80, 83 and 88 and the partitions 92 and 104 of the respective holder units 40 and 46 are similarly rounded to protect cards 14.

The card organizer device 10 is also provided with a front finger extension or tab 108 extending forward from the rim 84 between the holder units 42 and 44 and rear finger extension or tab 110 extending rearward from the rim 84. Since the holder units 40, 42, 44 and 46 are angled backwards at an angle of about 60°, the front tab 108 does not interfere with the front end wall 24 of cabinet 12 (FIG. 2). For a similar reason, the rear end wall 22 of the cabinet 12 is provided with a guide opening 112 that enables the rear finger tab 110 to extend outward through the rear end wall 22. That way, the front and rear finger tabs 108 and 110 provide for removing the card organizer device 10 from the cabinet 12.

As shown in FIG. 1A, the card organizer device 10 is completed by a removeable lid or cover 114 comprised of a top wall 116, opposed side walls 118 and 120 with front and rear end walls 122 and 124 between the side walls 118 and 120 and depending from the top plate 116. The cover 114 is sized to mount over the card organizer device 10 mounted in the cabinet 12 to protect the cards 14 held in the card organizer device 10.

IN USE

When the card organizer device 10 is mounted in the cabinet 12, the interior sidewalls 26, 28 and 30 of the cabinet 12 mount between the respective adjacent card holders 40, 42, 44 and 46. The interior sidewalls 26, 28 and 30 extend upwards from the bottom wall 16 of the cabinet 12, a distance of about 1.75 inches to 2.25 inches (4.45 cm to 5.72 cm). That way, the interior sidewalls 26, 28 and 30 provide for containing the sorted cards 14 in the respective boxes 32, 34, 36 and 38 of cabinet 12 and they provide for positioning the holder units 40, 42, 44 and 46 into the boxes 32, 34, 36 and 38.

As shown in FIG. 4, the interior sidewalls 26, 28 and 30 do not extend upwards as far as the outside sidewalls 18 and 20 of the cabinet 12. This enables the support tabs 81 and 89 and the support tabs between the second and third holders 42 and 44 to rest on the sidewalls 26, 28 and 30 while the bottom of the holder units 40, 42, 44 and 46 are supported on the bottom wall 16 of the cabinet 12. In this position, the organizer device 10 is ready to receive the cards 14.

The cards are sorted according to alphabetic, numerical or some other pertinent criteria. The sorted cards 14 are then inserted into the compartments 94, 98, 102 and 106 in the respective holders 40, 42, 44 and 46. The rims 80, 84 and 88 between the respective holders 40, 42, 44 and 46 and the rim 83 adjacent to the first sidewall 48 of holder 40 are provided with numerical indicia to designate the position of the compartments 94, 98, 102 and 106 in the holders 40, 42, 44 and 46. This is exemplified by the indicia 85 on rim 84 shown in FIG. 5. Preferably, there are fifty (50) or one hundred (100) individual compartments 94, 98, 102 and 106 in each of the holders 40, 42, 44 and 46. The cards 14 are preferably collectible cards having a height of about 3.5 inches (8.9 cm) and extend above the partitions a distance of about 1.0 inches (2.54 cm). This provides for removing the cards 14 from the organizer device 10. Also, if the cards 14 have a height similar to that of the partitions, the partitions can be provided with finger recesses (not shown) for removing the cards 14 from the card organizer device 10.

As shown in FIGS. 2 and 3, the finger tabs 108 and 110 provide a means for lifting the card organizer device 10 from the cabinet 12 to deposit the sorted cards 14 into the boxes 32, 34, 36 and 38 formed in the cabinet 12, through the open bottom of the holders 40, 42, 44 and 46. The deposited cards 14 thus lay in the boxes 32, 34, 36 and 38 in a fanned and sorted order. The sorted cards 14 are then removed from the cabinet 12 and placed back in a conventional set box container (not shown). The sorted cards 14 can then be held in the set box container for appreciation or resale.

The card organizer device 10 can be made of a plastic material, which can be injection molded as an integral unit, or fabricated from sheet plastic, cut to shape and solvent welded or bonded together. If an injection molded process is used to make the card organizer device 10, it is preferred that the compartments 94, 98, 102 and 106 between the respective partitions 92, 96, 100 and 104 be tapered to have a somewhat V-shaped cross-section as viewed from the side. This helps the mold release from the plastic.

The card holder device 10 can also be made from a stiff, moderately thick paper, such as cardboard. In this case, the cardboard would be cut to the proper shapes and the shaped members could be glued, taped or otherwise suitably connected together to form the card holder organizer device 10.

It is contemplated by the scope of the present invention that there can be preferably as few as 50 to as many as 100 or more compartments in each of the respective holder units 40, 42, 44 and 46. Also, the compartments 94, 98, 102 and 106 can be sized to hold more than one card 14. This would be useful for sorting duplicates into the compartments.

It is also contemplated by the scope of the present invention that the partitions need not necessarily extend the entire distance across the width of the holders 40, 42, 44 and 46. Instead, each of the partitions can be formed from a pair of plates (not shown) that extend from the sidewalls forming the holders. The plates would extend inwardly towards each other to form a space between the plates that would enable a user to reach into the holders 40, 42, 44 and 46 to remove a card 14 from the respective compartment. To construct the holders 40, 42, 44 and 46, the plates could be formed with small detents that snap into or are otherwise moved into corresponding openings in the respective sidewalls. This would be a relatively inexpensive method for building the present invention.

Furthermore, the respective holders 40, 42, 44 and 46 could be formed from elongate blocks (not shown) that are spaced apart and aligned in parallel. The blocks could be made of wood, plastic or other suitable materials that can be provided with angled cuts through the sidewall of the blocks to form slots spaced evenly along the length of the blocks. The blocks would then be connected by a rod or strip of rigid connecting material that would join at the front and the back of the blocks so that the cards 14 can be inserted into the slots formed in the blocks. By providing the blocks in a spaced apart relationship, there would be room between the blocks for a user to reach into the holders to remove the cards from the compartments. The angle cuts through the sidewall of the blocks would enable the cards 14 to be moved into and out of the blocks from either the top or the bottom of the blocks. This provides for depositing the cards 14 into the cabinet 12.

The term "card" can encompass any sheet material that needs to be sorted or organized according to an alphabetic, numerical or some other pertinent criteria. Thus, the term card can include, but is not limited to, paper sheet material such as collectible cards, checks, receipts, coupons, postcards, invoices, bills, pay stubs and the like. The term card can also encompass rigid materials such as tiles, and the like, or semi-rigid materials such as carpet samples and the like. Furthermore, the term card is not to be limited by the thickness of the sheet material and in fact a plurality of sheet material bound or otherwise connected together can be considered a card for purposes of the present invention.

It is intended that the foregoing descriptions be only illustrative of the present invention and that the present invention be limited only by the hereinafter appended claims.

I claim:

1. A device for organizing cards into a container means having a bottom wall and an sidewall extending from the bottom wall, which comprises:

(a) a holder means for holding and organizing the cards that is adapted to be removeably mounted in the container means, wherein the holder means is comprised of an open top and an open bottom and a surrounding sidewall between the open top and the open bottom and wherein when the holder means is mounted in the container means, the container means helps to support the holder means with the sidewall of the holder means adjacent to and inside of the sidewall of the container means; and (b) a plurality of partition means provided in the holder means to divide the holder means into a plurality of compartments adapted to receive cards moved into compartments of the holder means so that after the cards are moved into the compartments of the holder means, the holder means is removed from the container means and wherein the cards, moved into the compartments of the holder means, remain in the container means after the holder means is removed from the container means.

2. The card organizing device of claim 1 wherein there are a plurality of holder means connected side-by-side to form the organizing device and wherein the adjacent holder means are connected by a rim means.

3. The card organizing device of claim 2 wherein the rim means are provided with indicia that correspond to the compartments in the holder means.

4. The card organizing device of claim 1 wherein the partition means extend between opposed portions of the sidewall of the holder means.

5. The card organizing device of claim 4 wherein the holder means are provided with extension means that enable the card organizer device to be removed from the container means.

6. A device for organizing cards into a container means having a bottom wall with spaced apart sidewalls extending from the bottom wall and opposed end walls between the sidewalls, which comprises:

(a) a holder means that is adapted to be removeably mounted in the container means for holding and organizing the cards, wherein the holder means has an open top and an open bottom and is comprised of spaced apart sidewalls with opposed end walls between the sidewalls of the holder means and wherein when the holder means is mounted inside the container means, the container means helps to support the holder means with the spaced apart sidewalls of the holder means adjacent to the spaced apart sidewalls of the container means; and (b) a plurality of partition means mounted in the holder means to divide the holder means into a plurality of compartments adapted to receive cards moved into the holder means so that after the cards are moved into the compartments of the holder means, the holder means is removed from the container means and wherein the cards moved into the compartments of the holder means remain in the container means after the holder means is removed from the container means.

7. The card organizing device of claim 6 wherein there are a plurality of holder means connected side-by-side to form the organizing device and wherein the adjacent holder means are connected by a rim means.

8. The card organizing device of claim 7 wherein support means are provided between the adjacent holder means to provide lateral support for the card organizer device.

9. The card organizing device of claim 7 wherein the rim means are provided with indicia that correspond to the compartments in the holder means.

10. The card organizing device of claim 6 wherein the partition means extend between the spaced apart sidewalls of the holder means.

11. The organizing device of claim 10 wherein the partition means are spaced an equal distance apart.

12. The card organizing device of claim 6 wherein the partition means are mounted between the spaced apart sidewalls of the holder means at an angle of between 75 and 45 degrees from a vertical plane extending between the spaced apart sidewalls of the holder means.

13. The card organizing device of claim 6 wherein the sidewalls of the holder means are substantially longer than the end walls of the holder means to provide the holder means as an elongated member.

14. The card organizing device of claim 6 adapted to sort collectible cards.

15. The card organizer device of claim 6 wherein the holder means are provided with extension means that enable the card organizing device to be removed from the container means.

16. The card organizing device of claim 6 adapted to support a cover means when the card organizing device is mounted in the container means to protect the cards moved into the compartments of the holder means.

17. A device for organizing cards into a container means having a bottom wall with spaced apart sidewalls extending from the bottom wall, opposed end walls between the sidewalls and a plurality of interior walls extending between the opposed end walls and parallel to the spaced apart sidewalls of the container means to form a plurality of side-by-side open boxes in the container means which comprises:

(a) a plurality of holder means connected side-by-side that are adapted to be removeably mounted in the container means for holding the cards, wherein the holder means has an open top and an open bottom and is comprised of spaced apart sidewalls with opposed end walls between the sidewalls of the holder means, wherein when the holder means is mounted inside the container means, the container means helps to support the holder means with the spaced apart sidewalls of the holder means adjacent to the spaced apart sidewalls of the container means and wherein the holder means are adapted to be mounted over the interior walls of the container means so that the holder means are mountable in the respective boxes in the container means; and (b) a plurality of partition means mounted in the holder means to divide the holder means into a plurality of compartments adapted to receive cards moved into the holder means.

18. A method for organizing cards into a container means having a bottom wall with spaced apart sidewalls extending from the bottom wall and opposed end walls between the sidewalls, which comprises:

(a) providing a card organizing device, which comprises: a holder means for the cards having an open top and an open bottom and mountable in the container means, the holder means comprised of spaced apart sidewalls with opposed end walls between the sidewalls of the holder means; and a plurality of partition means in the holder means to divide the holder means into a plurality of compartments for receiving cards moved into the compartments of the holder means;

(b) mounting the card organizing device inside the container means so that the container means helps to support the card organizing device with the spaced apart sidewalls of the holder means adjacent to the spaced apart sidewalls of the container means;

(c) moving the cards into the compartments of the holder means to thereby organize the cards;

(d) removing the card organizing device from the container means to deposit the cards moved into the compartments of the holder means in the container means through the open bottom of the holder means; and (e) removing the cards from the container means and placing the organized cards in a package means.

19. The method of claim 18 wherein there are a plurality of holder means connected side-by-side to form the organizing device and wherein the adjacent holder means are connected by a rim means and wherein the plurality of holder means connected by rim means are moved into the container means which supports the holder means as cards are moved into the compartments of the holder means.

20. The method of claim 19 wherein support means are provided between the adjacent holder means and wherein the support means help to support the card organizer device as the organizer device is removed from the container means.

21. The method of claim 19 wherein the rim means are provided with indicia that correspond to the compartments in the holder means to aid in organizing the cards as the cards are moved into the compartments of the holder means.

22. The method of 18 wherein the holder means are provided with extension means and wherein the holder means are removed from the container means by grasping the extension means.

23. The method of claim 18 wherein a cover means is mounted over the card organizer device mounted in the container means to protect the cards held in the compartments of the holder means.

24. The method of claim 18 wherein the cards are originally held in the package means in a random order before they are moved into the compartments of the holder means to organize the cards before they are returned to the package means.

25. A method for organizing cards into a container means having a bottom wall with spaced apart sidewalls extending from the bottom wall and opposed end walls between the sidewalls, which comprises:

(a) providing a card organizing device, which comprises: a holder means for the cards having an open top and an open bottom and mountable in the container means, the holder means comprised of spaced apart sidewalls with opposed end walls between the sidewalls of the holder means; and a plurality of partition means in the holder means to divide the holder means into a plurality of compartments for receiving cards moved into the compartments of the holder means; wherein the partition means are mounted between the spaced apart sidewalls of the holder means at an angle of between 75 and 45 degrees from a vertical plane extending between and perpendicular with the spaced apart sidewalls of the holder means wherein the angled partition means aid a user moving the cards into the compartments;

(b) mounting the holder means inside the container means so that the container means helps to support the holder means with the spaced apart sidewalls of the holder means adjacent to the spaced apart sidewalls of the container means;

(c) moving the cards into the compartments of the holder means to thereby organize the cards;

(d) removing the holder means from the container means to deposit the cards moved into the compartments of the holder means in the container means through the open bottom of the holder means; and (e) removing the cards from the container means and placing the organized cards in a package means.

26. A method for organizing cards into a container means having a bottom wall with spaced apart sidewalls extending from the bottom wall, opposed end walls between the sidewalls and a plurality of interior walls extending between opposed end walls and parallel to the spaced apart sidewalls of the container means to form a plurality of side-by-side open boxes in the container means, which comprises:

(a) providing a card organizing device, which comprises: a plurality of holder means connected side-by-side for the cards having an open top and an open bottom and mountable in the container means, the holder means comprised of spaced apart sidewalls with opposed end walls between the sidewalls of the holder means wherein the holder means are adapted to be mounted over the interior walls of the container means so that the side-by-side holder means are mounted in the respective boxes in the container means; and a plurality of partition means in the holder means to divide the holder means into a plurality of compartments for receiving cards moved into the compartments of the holder means;

(b) mounting the holder means inside the container means so that the container means helps to support the holder means with the spaced apart sidewalls of the holder means adjacent to the spaced apart sidewalls of the container means;

(c) moving the cards into the compartments of the holder means to thereby organize the cards;

(d) removing the card organizing device from the container means to deposit the cards moved into the compartments of the holder means into the boxes of the container means through the open bottom of the holder means; and (e) removing the cards from the container means and placing the organized cards in a package means.

* * * * *